US006540957B1

(12) United States Patent
Hara et al.

(10) Patent No.: US 6,540,957 B1
(45) Date of Patent: Apr. 1, 2003

(54) LADLE, A LADLE HEATING SYSTEM AND METHODS OF HEATING THE LADLE

(75) Inventors: Kazuaki Hara, Okayama (JP); Kazunari Andachi, Okayama (JP); Hiroshi Nomura, Okayama (JP); Mamoru Suda, Okayama (JP); Daisuke Takahashi, Okayama (JP); Nobutaka Goto, Okayama (JP); Kiyoshi Takahashi, Okayama (JP); Ryoji Nagai, Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/644,133

(22) Filed: Aug. 23, 2000

(30) Foreign Application Priority Data

| | | |
|---|---|---|
| Aug. 27, 1999 | (JP) | 11-242005 |
| Aug. 27, 1999 | (JP) | 11-242006 |
| Aug. 27, 1999 | (JP) | 11-242007 |
| Sep. 20, 1999 | (JP) | 11-265277 |
| Dec. 27, 1999 | (JP) | 11-370195 |

(51) Int. Cl.[7] ..... C21B 13/00

(52) U.S. Cl. ..... 266/44; 266/901; 432/9; 432/37

(58) Field of Search ..... 266/44, 88, 155, 266/901; 432/9, 37

(56) References Cited

U.S. PATENT DOCUMENTS

| | | | | |
|---|---|---|---|---|
| 4,223,873 A | | 9/1980 | Battles | |
| 4,364,729 A | * | 12/1982 | Fresch | 432/9 |
| 4,718,643 A | * | 1/1988 | Gitman | 266/44 |

FOREIGN PATENT DOCUMENTS

| | | | |
|---|---|---|---|
| EP | 0 331 882 A1 | | 9/1989 |
| EP | 1 078 704 | | 2/2001 |
| FR | 2 377 595 | | 8/1978 |
| JP | 357108215 A | * | 7/1982 |
| JP | 61 060261 | | 3/1986 |
| JP | 07 112269 | | 5/1995 |
| JP | 08 197233 | | 8/1996 |
| JP | 11 047916 | | 2/1999 |

* cited by examiner

*Primary Examiner*—Scott Kastler
(74) *Attorney, Agent, or Firm*—Schnader Harrison Segal & Lewis LLP

(57) ABSTRACT

A ladle after teeming for a continuous casting and a subsequent slag discharge is mounted on a ladle truck and then moved by the ladle truck to a tapping station. The ladle on the ladle truck is then stationed over a predetermined stand-by time and is then immediately moved to a tapping position to receive a molten steel from a converter. The ladle is quickly heated during the stand-by time, by a regenerative-type burner system carried by a ladle lid which is attached to the ladle to cover the top opening of the ladle. This allows the tapping temperature of the molten steel to be set to a low level, offering advantages such as a remarkable reduction in the consumption of carbonaceous materials as the temperature controller, as well as extended life of ladle refractories through suppression of thermal attack. At the same time, consumption of fuel gas for heating the ladle by the burner system is reduced to contribute to saving of energy.

14 Claims, 10 Drawing Sheets

LADLE, A LADLE HEATING SYSTEM AND METHODS OF HEATING THE LADLE

BACKGROUND OF THE INVENTION

1. Field of the Invention

The present invention relates to a ladle which is used in a converter process to convey molten steel received from a converter and, more particularly, to a method of heating a ladle.

2. Description of the Related Art

A description will be given first of a conventional art.

1) Referring to FIG. 3, a ladle 1 used in a converter process is used to supply molten steel to a continuous casting process and is thereafter moved to a slag discharge station B1 by means of a crane 2 or the like. At the slag discharge station B1, the ladle 1 is tilted so that slag remaining in the ladle is discharged. The ladle is then moved to an inspection/maintenance station (not shown) where a sliding nozzle is scrubbed or replaced with a new sliding nozzle. The ladle is then moved to a pre-heating station C1 where the ladle 1 is pre-heated by means of, for example, a burner (not shown) to dehydrate the ladle 1 and make up for any reduction of the temperature of molten steel which is to be received from a converter 3.

The ladle 1 is then moved by, for example, the crane 2 mounted on a steel carrier ladle truck 5 which transports the ladle 1 to a tapping station D1. The ladle 1 which has been moved to the tapping station D1 is stationed for a predetermined period of time and, thereafter; receives molten steel directly from converter 3. After receiving the molten steel, the ladle 1 is again moved by the ladle truck 5 to a secondary refining station (not shown) where the molten steel in the ladle 1 is subjected to a secondary: refining performed by, for example, an RF method.

Subsequently, the ladle 1 on the ladle truck 5 is conveyed by, for example, the crane 2 to a continuous casting station A1. The ladle 1 conveyed to this station A1 is mounted on a continuous casting machine, and a sliding nozzle provided on the bottom of the ladle 1 is opened and closed, whereby the molten steel is continuously teemed into a tundish at an appropriate rate, so as to be cast continuously. The ladle 1 is then subjected again to the described process.

The tapping temperature at which the molten steel is discharged from the converter 3 is so determined and controlled that the molten steel is maintained high enough to enable the casting until the end of the continuous casting. As a consequence, the tapping temperature is largely ruled by the reduction in the temperature which the molten steel 1 sustains while the molten steel is held in the ladle 1.

In the conventional converter process, however, a considerably long time is involved from the pre-heating of the ladle 1 in the pre-heating station C1 until the ladle 1 receives the molten steel at the tapping station D1. In particular, the temperature of the ladle refractory is lowered due to natural heat dissipation while the ladle 1 is stationed for receiving the molten steel at the tapping station. This causes a large temperature drop of the molten steel received in the ladle 1. This requires the tapping temperature at which the molten steel is discharged from the converter to be set at a high level so that the molten steel temperature is high enough for casting even at the end of continuous casting. As a result, a greater amount of carbonaceous material such as coke, which is supplied into the molten steel to act as a temperature-raising material during blowing in the converter process, is consumed.

In addition, a greater degree of thermal attack is caused on the ladle refractory lining, due to the large difference between the temperature of the ladle refractory lining and the tapping temperature at which the molten steel is discharged from the converter, with the result that the refractory lining cannot be sustained for extended use. Further, the molten steel in the ladle 1 exhibits large local variations in temperature.

Furthermore, pre-heating the ladle at the pre-heating station requires a long time and, hence, consumes a large quantity of combustion gas (C gas) for pre-heating.

The present invention is aimed at overcoming these problems of the known art. Thus, it is an object of the present invention to provide a method of heating a ladle which permits the tapping temperature at which the molten steel is discharged from a converter to be set to a low level to permit reduction in the consumption of carbonaceous material, while suppressing thermal attack on the ladle refractory material to improve the unit ratio of the refractories, and which reduces consumption of the combustion gas used for heating the ladle by burners, thus contributing to saving energy.

2) A heating method has been known for heating a ladle by means of regenerative-type burners while closing the top opening of the ladle by means of a ladle lid on which the burners are mounted. This type of heating method is disclosed, for example, in Japanese Unexamined Patent Application Publication No. 7-112269.

This heating method employs a pair of burner units which alternately supply fresh air and discharges combustion exhaust gas,.while recovering heat through a heat regenerator disposed therebetween. These burner units are mounted on the ladle lid which closes the top opening of the ladle. The pair of burner units alternately perform combustion. While one of the burner units is operating to heat the ladle, the combustion gas after the heating is exhausted and recovered through an exhaust gas pipe which runs through a heat regenerator which is associated with the other burner unit.

In a steady operation of this type of regenerative-type burner equipment, the rate of recovery of the exhaust gas is set to be almost equal to the rate of supply of the combustion air, for the reason stated below. Recovery of the exhaust gas at a rate in excess of the rate of supply of the combustion air causes the exhaust gas temperature at the heat-accumulator outlet to rise to an extraordinarily high level, beyond temperatures which can be sustained by structural members supporting the heat regenerator and devices arranged in the exhaust gas pipe such as a change-over valve and an exhaust fan. This makes the whole heating system inoperative and impractical. For this reason, the rate of recovery of the combustion exhaust gas is controlled to be almost equal to the rate of supply of the combustion air, from the beginning to the end of combustion.

This controlling method, however, suffers from the following disadvantage. Namely, at the beginning of combustion, most of the exhaust gas recovered through the exhaust gas pipe is used for heating the heat regenerator. In this state, the temperature of the combustion air after the heat exchange across the heat regenerator is considerably lower than the temperature of the exhaust gas collected from the ladle, so that the heat recovery ratio is undesirably low. With this controlling method, it is impossible to rapidly heat the ladle in a short time, because the combustion temperature and, hence, the combustion gas temperature cannot be raised in the beginning period of the combustion.

In view of this problem, another object of the present invention is to provide a quick heating method for rapidly heating a ladle by means of a regenerative-type burner system, wherein the high temperature of the atmosphere in the ladle is maintained without allowing the combustion gas at the heat-accumulator outlet to exceed the temperature tolerable by the heat regenerator supporting structure and the devices in the exhaust gas pipe such as a change-over valve, thus achieving high heating efficiency for heating the ladle.

3) In the known art for heating the ladle, the ladle is transported to a predetermined station by means of a truck, where the top opening of the ladle is closed by the ladle lid on which burners are mounted. Heating the ladle is conducted by combustion of a fuel by means of the burner system on the ladle lid closing the top opening of the ladle, while the combustion gas is exhausted therefrom. Movement of the ladle lid carrying the burner system is performed by means of a crane or the like.

The work for moving the ladle lid with the burner system onto and from the ladle is extremely laborious and time-consuming. In addition, there is a risk that the brim of the top opening of the ladle may be damaged by an impact produced when the ladle lid carrying the burner system is placed on the ladle.

The invention also is contemplated to overcome this problem. Thus, still another object of the present invention is to provide a ladle lid lifting apparatus for lifting and lowering a ladle lid carrying a burner system, which facilitates the work for opening and closing the top opening of a ladle with the ladle lid, while avoiding damaging of the brim of the top opening of the ladle.

SUMMARY OF THE INVENTION

1. First aspect—quick heating of ladle by regenerative-type burner system

To these ends, according to one aspect of the present invention, there is provided a method of heating a ladle in a process in which the ladle after teeming for continuous casting and subsequent slag discharge is mounted on a ladle truck or mover and then moved by the ladle truck to a tapping station, the ladle on the ladle truck being then stationed over a predetermined stand-by time, the ladle then being moved to a tapping position to receive a molten steel from a converter, the heating being executed before the ladle receives the molten steel from the converter. In accordance with this method, the ladle is quickly heated within the predetermined stand-by time in which the ladle is stationed in the tapping station.

Preferably, heating is performed by means of a regenerative-type burner system carried by a ladle lid which is attached to the ladle to cover the top opening of the ladle.

2. Second aspect—Prevention of temperature drop of ladle

In accordance with a second aspect, there is provided a method of heating a ladle in a process in which the ladle after teeming for .continuous casting and subsequent slag discharge is mounted on a ladle truck and then moved by the ladle truck to a tapping station, the ladle on the ladle truck then being stationed over a predetermined stand-by time, the ladle then being immediately moved to a tapping position to receive a molten steel from a converter, the ladle then being conveyed by the ladle truck to a secondary refining station and, after the secondary refining, moved further to the continuous casting station to teem the molten steel for the continuous casting.

The ladle heating method comprises quickly heating the ladle within a predetermined period in which the ladle is stationed at a tapping station where the ladle is to receive a molten steel from a converter, by means of a burner system mounted on a first ladle lid for covering and closing the top opening of the ladle; and keeping the top opening of the ladle covered by a second-ladle lid in operational phase other than slag discharging, quick heating, tapping and secondary refining.

3. Third aspect of the Invention—Heat balance on regenerative-type burner

In accordance with a third aspect of the present invention, there is provided a method of quickly heating a ladle by means of a regenerative-type burner system, comprising the steps of: closing a top opening of the ladle by means of a ladle lid carrying the burner system, the burner system having a pair of burner units each having a heat regenerator, the burner units being alternately operable such that, when one of the burner units is activated to perform combustion, supply of the combustion air and the discharge of the combustion exhaust gas are conducted through the heat regenerator of the other burner unit; alternately activating the burner units to perform combustion while the top opening of the ladle is kept closed by the ladle lid; recovering the combustion exhaust gas through an exhaust gas pipe via the heat regenerator of the burner which is not operating; and controlling the rate of recovery of the combustion exhaust gas by controlling a flow rate control valve provided in the exhaust gas pipe, based on the temperature of the combustion exhaust gas measured at the outlet of the heat regenerator.

There is provided also a method of quickly heating a ladle by means of a regenerative-type burner system, comprising the steps of: closing a top opening of the ladle by means of a ladle lid carrying the burner system, the burner system having a pair of burner units each having a heat regenerator, the burner units being alternately operable such that, when one of the burner units is activated to perform combustion, supply of the combustion air and the discharge of the combustion exhaust gas are conducted through the heat regenerator of the other burner unit; alternately activating the burner units to perform combustion while the top opening of the ladle is kept closed by the ladle lid, while recovering the combustion exhaust gas through an exhaust gas pipe via the heat regenerator of the burner which is not operating; and controlling a flow rate control valve provided in the exhaust gas pipe, in accordance with a flow rate pattern of the combustion exhaust gas flowing through the exhaust gas pipe, the flow rate pattern being set up beforehand based on the relationship between the temperature of the combustion exhaust gas at the outlet of the heat regenerator and the rate of recovery of the combustion exhaust gas.

The regenerative-type burner units may be provided with pilot burners. Before the regenerative-type burners are activated, the pilot burners are operated to perform combustion, thereby pre-heating the regenerators.

4. Fourth Aspect of the Invention—Control of tapping temperature

In accordance with a fourth aspect of the present invention, there is provided a method of heating a ladle in a process in which a ladle after teeming for continuous casting and subsequent slag discharge is mounted on a ladle truck and then moved by the ladle truck to a tapping station, the ladle on the ladle truck being then stationed over a predetermined stand-by time, the ladle being then immediately moved to a tapping position to receive molten steel from a converter, the heating of the ladle being performed before the ladle receives the molten steel from the converter, the heating method comprising the steps of: quickly heating, during the predetermined stand-by time, the ladle with regenerative-type burner system carried by a ladle lid attached to the ladle to cover the top opening of the ladle; determining the amount of heat possessed by the ladle refractory material based on the amount of heat input and the sensible heat carried by the exhaust gas; determining, based on the amount of heat possessed by the ladle refractory material, the tapping rate at which the molten steel is discharged from the converter and the specific heat of the molten steel, a molten steel cool-down prevention temperature given to the ladle by the quick heating of the ladle; and controlling the tapping temperature at which the molten steel is discharged from the converter, in accordance with the molten steel cool-down prevention temperature.

5. Fifth Aspect of the Invention—Ladle lid lifting apparatus

In accordance with a fifth aspect of the present invention, there is provided a ladle lid lifting apparatus for lifting and lowering a ladle lid to open and close a top opening of a ladle that has been moved to and stationed at a predetermined position by a ladle truck, the ladle lid being provided with a burner system, the ladle lid lifting apparatus comprising: a supporting frame arranged to straddle over the path of the ladle truck carrying the ladle stationed at the predetermined position; a first chain or suspender supporting and suspending the ladle lid with the burner system for substantially vertical movement, the first chain extending upward from the ladle lid and then substantially horizontally after turning a first sprocket carried by the supporting frame, the end portion of the substantially horizontal extension of the first chain being connected to a connecting member; a second chain or suspender connected to the connecting member and extending substantially horizontally away from the first chain and then downward after turning a second sprocket carried by the supporting frame, the end portion of the downward extension of the second chain being connected to a counter weight having a weight which substantially balances the weight of the ladle lid inclusive of the burner system; driving means for driving the second sprocket to cause substantially vertical movement of the ladle lid with the burner system; guiding means for guiding the ladle lid with the burner system when the ladle lid moves up and down; and a combustion air supply pipe, an exhaust gas pipe and a fuel gas supply pipe connected to the burner system on the ladle lid, the combustion air supply pipe, exhaust gas pipe and the fuel gas supply pipe having substantially vertically extending portions including bellows that accommodate the vertical movement of the ladle lid.

These and other objects, features and advantages of the present invention will become clear from the following description of the preferred embodiment when the same is read in conjunction with the accompanying drawings.

DESCRIPTION OF THE PREFERRED EMBODIMENTS

1. First and Fifth Aspects of the Invention

Preferred embodiments of the present invention will be described with reference to the accompanying drawings.

(1) Quick Heating Method

Figure 1:
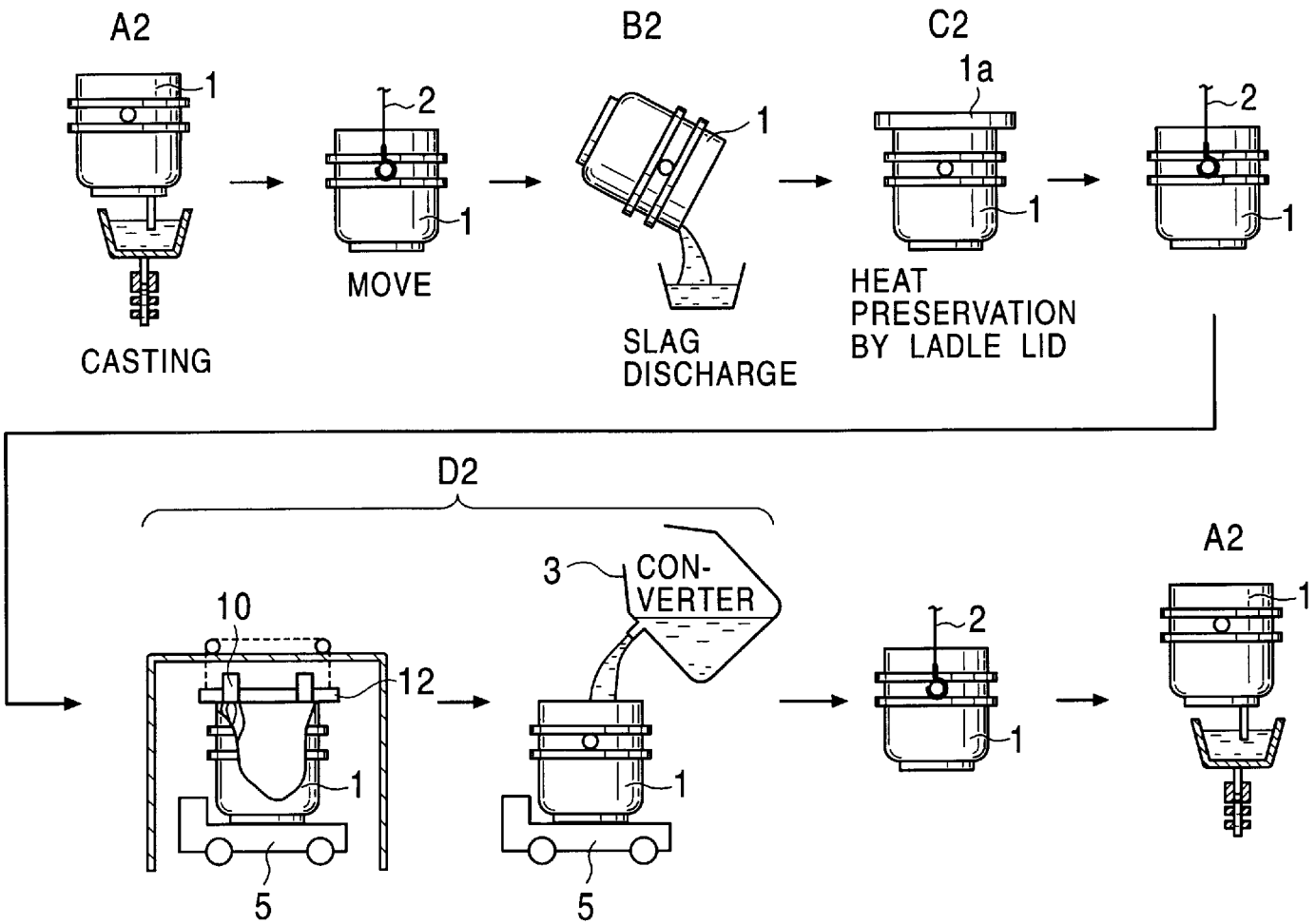
FIG. 1 is an illustration of an embodiment of selected steps in a ladle heating method in accordance with the present invention.

Referring to FIG. 1, a ladle 1 is used in a converter process. After delivering molten steel to a continuous casting process at A2, the ladle 1 is moved by, for example, a crane 2 to a slag discharge station B2 where the ladle 1 is tilted to:discharge slag remaining in the ladle 1. The ladle 1 is then moved to an inspection/maintenance station (not shown) where a sliding nozzle of the ladle 1 is scrubbed or replaced. The ladle 1 is then moved to a heat-preservation station C2 where, unlike the conventional process in which the ladle is heated by burners, the top opening of the ladle 1 is covered and closed with a ladle lid la to preserve heat of the ladle 1.

Subsequently, the ladle 1 is placed on a ladle truck 5 by means of, for example, a crane 2, and the ladle truck 5 brings the ladle 1 to a tapping station D2 at which the ladle 1 is stationed for receiving molten steel tapped from a converter 3. More specifically, the ladle 1 on the ladle truck 5, upon reaching the tapping station, is stationed over a predetermined stand-by time. During this stand-by time, a regenerative-type burner system 10 operates to quickly heat the ladle 1, to dehydrate the ladle 1 and compensate for lowering of the temperature of the molten steel tapped from the converter 3.

Subsequent to the quick heating, the ladle 1 receives the molten steel tapped from the converter 3. The ladle truck 5 then brings the ladle 1 to a secondary refining station (not shown), where the molten steel inside the ladle 1 is subjected to a secondary refining by, for example, an RH method.

Then, the ladle 1 is conveyed by a crane 2 or the like from the ladle truck 5 to the continuous casting station A2, where the ladle 1 is situated on a continuous casting apparatus of a known type. In this state, the sliding nozzle provided on the bottom of the ladle 1 is opened, so that the molten steel is supplied at an appropriate rate to a tundish, whereby the continuous casting process is executed. The described series of operations are preferably cyclically performed.

(2) Ladle Lid Lifting Apparatus

Figure 4:
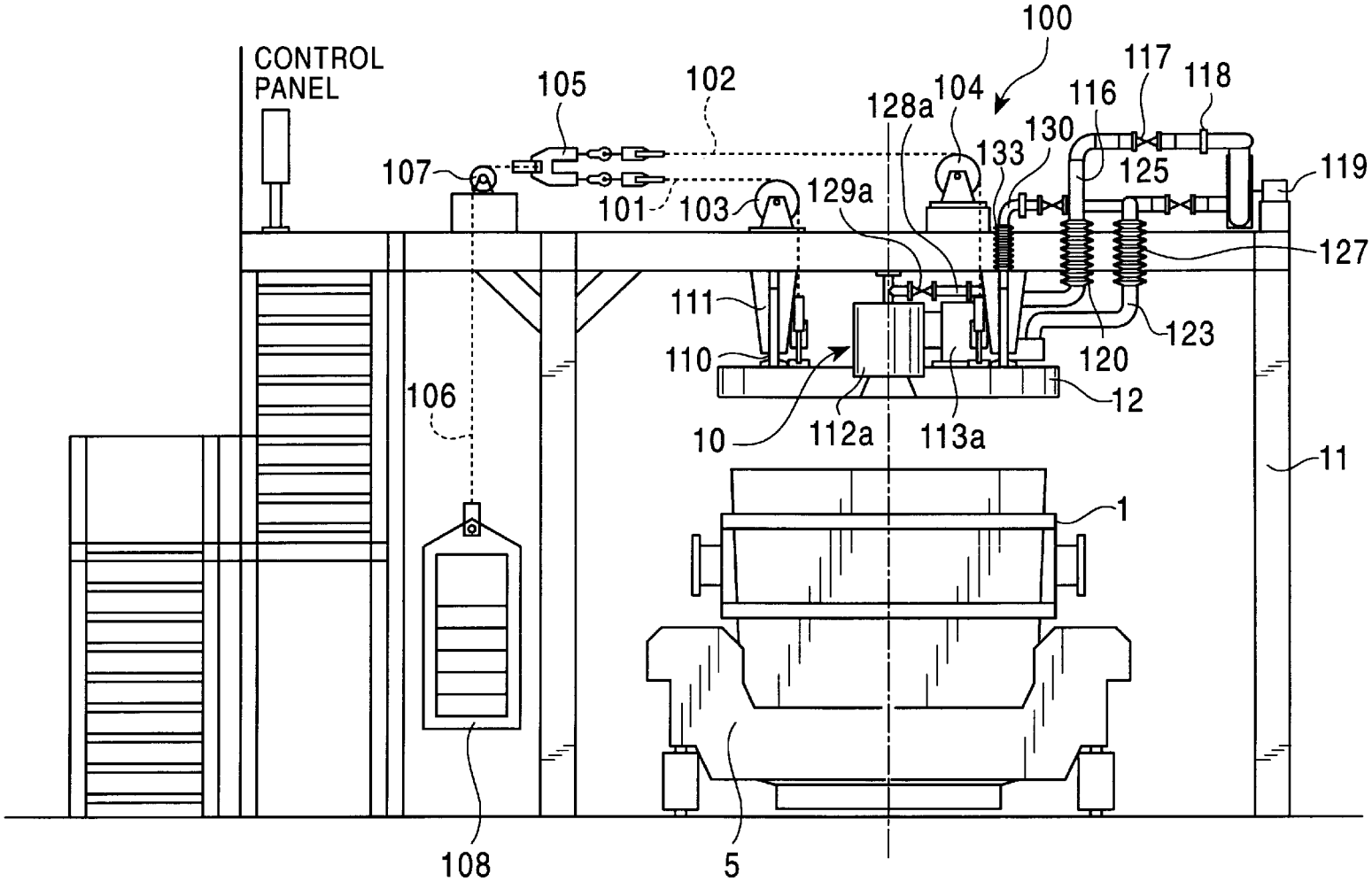
FIG. 4 is a schematic front elevational illustration of, by means of a burner system, a ladle which is carried by a truck that has been stationed at a tapping station.
Figure 5:
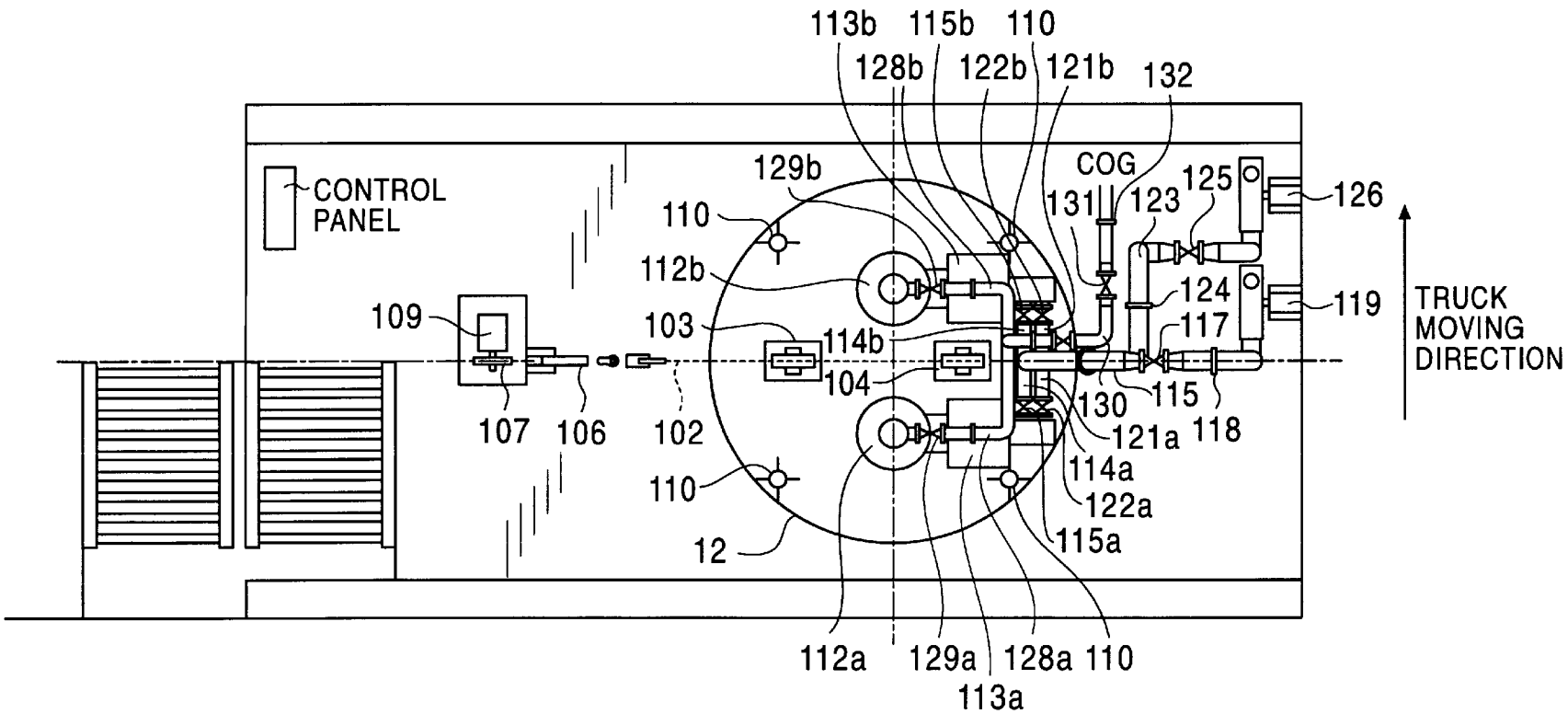
FIG. 5 is a top plan view of the arrangement shown in FIG. 4.
Figure 6:
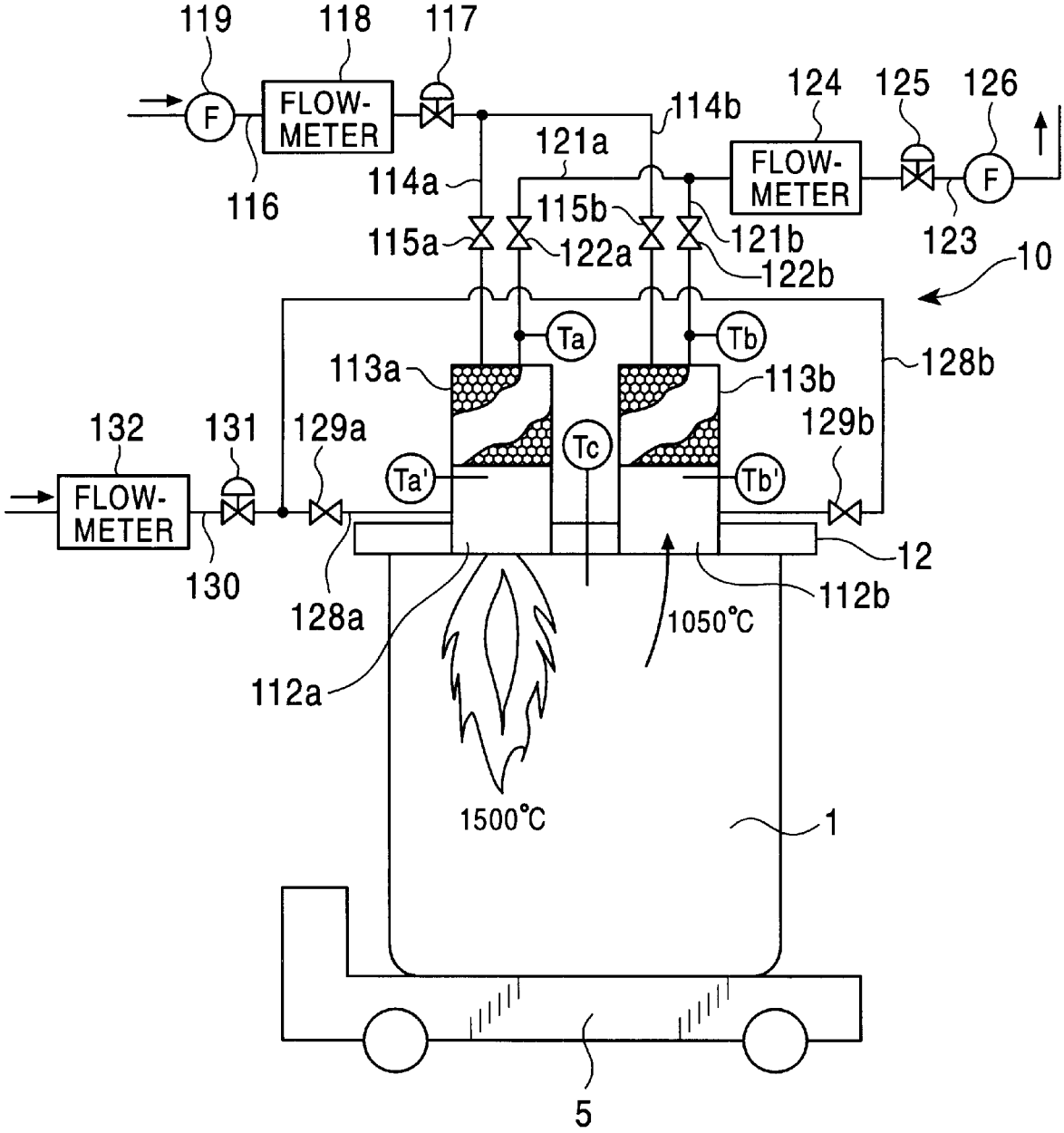
FIG. 6 is a schematic front elevational illustration of a heat-accumulating burner system in operation.

A detailed description will now be given of the method for quickly heating, by the heat accumulation type burner system 10, the ladle 1 on the ladle truck 5 stationed at the tapping station D2, with specific reference to FIGS. 4 to 6. Referring first to FIGS. 4 and 5, a portal frame 11 is arranged to straddle a path of a ladle truck 5 which is stationed at the tapping station D2 (from FIG. 2). The portal frame 11 has a lifting apparatus 100 which suspends a circular ladle lid 12 such that the ladle lid 12 can be lifted and lowered to open and close a top opening of the ladle 1 on the ladle truck 5. The ladle lid 12 carries a regenerative-type burner system 10.

The configuration of the lifting apparatus 100 is as follows. The lifting apparatus 100 has a pair of chains 101 and 102 which liftably hold the ladle lid 12 at a two portions of the surface of the ladle lid 12 that are spaced from each other in the direction of the breadth of the ladle truck 5. More specifically, the chains 101 and 102 extend upward from the ends retained on the surface of the ladle lid 12 and, after going around sprockets 103 and 104, respectively mounted on the portal frame 11, extend substantially horizontally. The ends of these chains 101 and 102 are connected to bifurcated ends of a common connector member 105.

A single chain 106 is connected at its one end to the other end of the connector member 105 and extends horizontally away from the chains 101 and 102 and, after going around a sprocket 107 mounted on the portal frame 11 extends downward to suspend at its other end a counter weight 108. The counter weight 108 has a weight which substantially balances the weight of the ladle lid 12 inclusive of the regenerative-type burner system 10.

The sprocket 107 is driven by a driving motor 109 which is reversible, to lift and lower the ladle lid 12 together with the burner system 10. To ensure smooth movement of the ladle lid 12 up and down, four slide rods 110 provided on the upper surface of the ladle lid 12 are guided by corresponding guide sleeves 111 which are provided on the portal frame 11.

(3) Regenerative-type Burner

A description of the regenerative-type burner 10 will now be given, with special reference to FIG. 6. The regenerative-type burner 10 has a pair of burner units 112*a* and 112*b* which are mounted on the upper surface of the ladle lid 12 at positions spaced from each other in the direction of movement of the ladle truck 5. Heat regenerators 113*a* and 113*b* made of ceramics type material are integrally provided on the burner units 112*a* and 112*b*, respectively. A combustion air supply pipe 114*a* and an exhaust gas pipe 121*a* are connected to the heat regenerator 113*a*. Likewise, a combustion air supply pipe 114*b* and an exhaust gas pipe 121*b* are connected to the heat regenerator 113*b*.

The combustion air supply pipes 114*a* and 114*b* are provided with change-over valves 115*a* and 115*b*, respectively. The combustion air supply pipes 114*a* and 114*b* have upstream ends which branch from a single combustion air supply pipe 116. The combustion air supply pipe 116 has a flow-rate control valve 117 and a flow meter (orifice) 118 upstream of the flow rate control valve 117, and is coupled at its upstream end to a blower 119 mounted on the portal frame 11. As will be seen from FIG. 4, the combustion air supply pipe 116 has a portion which extends substantially vertically and which has a bellows 120 that accommodates vertical stroking of the ladle lid 12.

The exhaust gas pipes 121*a* and 121*b* have change-over valves 122*a* and 122*b*, respectively. The exhaust gas pipes 121*a* and 121*b* also have thermometers Ta and Tb upstream of the change-over valves 122*a* and 122*b* arranged to measure temperatures of the exhaust gas at the outlets of the heat regenerators 113*a* and 113*b*, respectively. The exhaust gas pipes 121*a* and 121*b* merge at their downstream ends into a single exhaust gas pipe 123 which is provided with a flow meter (orifice) 124 and a flow rate control valve 125 downstream of the flow rate control valve 124. The downstream end of the exhaust gas pipe 123 reaches an exhaust fan 126 which is mounted on the portal frame 11. As will be seen from FIG. 4, the exhaust gas pipe 123 has a portion which extends substantially vertically and has a bellows 127 that accommodates vertical stroking of the ladle lid 12.

To the burner units 112*a* and 112*b* are connected fuel gas supply pipes 128*a* and 128*b*, respectively. These fuel supply pipes 128*a* and 128*b* are respectively provided with change-over valves 129*a* and 129*b*. The fuel supply pipes 128*a* and 128*b* have upstream ends branching from a single common fuel supply pipe 130. The fuel supply pipe 130 has a flow-rate control valve 131 and a flow meter (orifice) 132 upstream of the flow rate control valve 117. As will be seen from FIG. 4, the fuel supply pipe 130 has a portion which extends vertically and which has a bellows 133 that accommodates vertical stroking of the ladle lid 12. A symbol Tc appearing in FIG. 6 designates a thermometer which measures the temperature inside the ladle 12.

A description will now be given of a method for heating the ladle 1, by using the regenerative-type burner system 10.

The ladle truck 5 carrying the ladle 1 is moved to bring the ladle 1 to the tapping station D2 beneath the converter 3 and is stationed at a predetermined position with respect to the portal frame 11. The arrival of the ladle truck 5 at this position is detected by a position sensor (not shown) provided on the portal frame 11. In accordance with a signal .from the position sensor, the driving motor 109 mounted on the portal frame 11 is activated to drive the sprocket 107 in the direction to raise the counter weight 108. As a result, the ladle lid 12 carrying the regenerative-type burner system 10 is lowered to and seated on the ladle 1 to cover the top opening of the ladle 1. It will be appreciated that the seating of the ladle lid 12 is performed without giving any substantial impact on the brim of the top opening of the ladle 1, because the weight of the ladle lid 12 inclusive of the weight of the burner system 10 is balanced by the weight of the counter weight 108, thus suppressing the risk of damaging of the top opening brim of the ladle.

In this state, combustion is performed by alternately activating the burner units 112*a* and 112*b*, thereby quickly heating the ladle 1 during the period in which the ladle truck 5 is stationed in the stand-by condition.

When, for example, the burner unit 112*a* is activated, 1) the change-over valve 115*a* of the combustion air supply pipe 114*a*, 2) the change-over valve 129*a* of the fuel gas supply pipe 128*a*, and 3) the change-over valve 122*b* of the exhaust gas pipe 121*b* are opened, while 1) the change-over valve 115*b* of the combustion air supply pipe 114*b*, 2) the change-over valve 129*b* of the fuel gas supply pipe 128*b*, and 3) the change-over valve 122*a* of the exhaust gas pipe 121*a* are closed. Thus, the fuel gas supplied through the burner unit 112*a* is burned to form flame and combustion gas which radiate heat to heat the ladle 1. The exhaust gas is discharged through the heat regenerator 113*b* and the exhaust pipes 121*b* and 123.

Conversely, when the burner unit 112*b* is activated, 1) the change-over valve 115*b* of the combustion air supply pipe 114*b*, 2) the change-over valve 129*b* of the fuel gas supply pipe 128*b*, and 3) the change-over valve 122*a* of the exhaust gas pipe 121*a* are opened, while 1) the change-over valve 115*a* of the combustion air supply pipe 114*a*, 2) the change-over valve 129*a* of the fuel gas supply pipe 128*a*, and 3) the change-over valve 122*b* of the exhaust gas pipe 121*b* are closed. Thus, the fuel gas supplied through the burner unit 112*b* is burned to form flame and combustion gas which radiate heat to heat the ladle 1. The exhaust gas is discharged through the heat regenerator 113*a* and the exhaust pipes 121*a* and 123.

The switching of the change-over valves 115*a*, 115*b*, 122*a*, 122*b*, 129*a* and 129*b*, as well as control of the flow rate control valves 117, 125 and 131 based on the flow rates as measured by the flow meters 118, 124 and 132, is sequentially performed by a heating control device which is not shown.

By the alternate operation of the burner units 112*a* and 112*b*, the combustion air to be supplied to the burner units 112*a* and 112*b* are pre-heated to a high temperature approximating that of the exhaust gas, through direct contact with the heat regenerators 113*a* and 113*b*, to enable stable combustion with a lean mixture having a smaller fuel gas content, whereby the ladle 1 is quickly heated. Quick heating occurs in a time range from about 5 min. to 60 min. at the temperature from 400–900° C. to 700–1200° C.

After the quick heating of the ladle 1, the driving motor 109 mounted on the portal frame 11 is reversed to drive the sprocket 107 in the direction to lower the counter weight 108, whereby the ladle lid 12 carrying the regenerative-type burner system 10 is lifted to open the top end of the ladle 1. Immediately after the lifting of the ladle lid 12, the ladle 1 is moved to the tapping position to receive molten steel from the converter 3. The ladle truck 5 carrying the ladle 1 filled with molten steel is then moved to bring the ladle 1 to a secondary refining station (not shown), where the molten steel inside the ladle 1 is subjected to a secondary refining process. After secondary refining, the ladle 1 is conveyed by the crane 2, for example, to the continuous casting station A2 where continuous casting is performed.

In this embodiment, the amount of heat possessed by the ladle refractory material is remarkably increased as compared to known methods, by virtue of the fact that heating of ladle 1 is continued to a moment immediately before the tapping. This permits the tapping temperature at which the molten steel is supplied from the converter 3 to be set at a level significantly lower than that in the known methods, without allowing the molten steel temperature to come down below a casting temperature at the end of the continuous casting. This serves to reduce the amount of the carbonaceous material such as coke which is supplied as temperature-raising materials during blowing of the molten steel in the converter.

Further, the difference between the temperature of the ladle 1 and the tapping temperature at which the molten steel id discharged from the converter can be reduced to suppress thermal attack on the ladle refractory material, thus enabling longer use of such refractories. At the same time, local variations of the molten steel temperature inside the ladle 1 are reduced.

Furthermore, the heating time over which the ladle 1 is heated by the burner system can be shortened as compared with the known art in which the heating of the ladle 1 by the burner is performed while the ladle 1 is stationed in the pre-heating station C1. This serves to reduce the amount of the fuel gas (C gas) used during the heating, thus contributing to saving energy.

2. Second Aspect of the Invention (1) Prevention of Temperature Drop of Ladle

Figure 2:
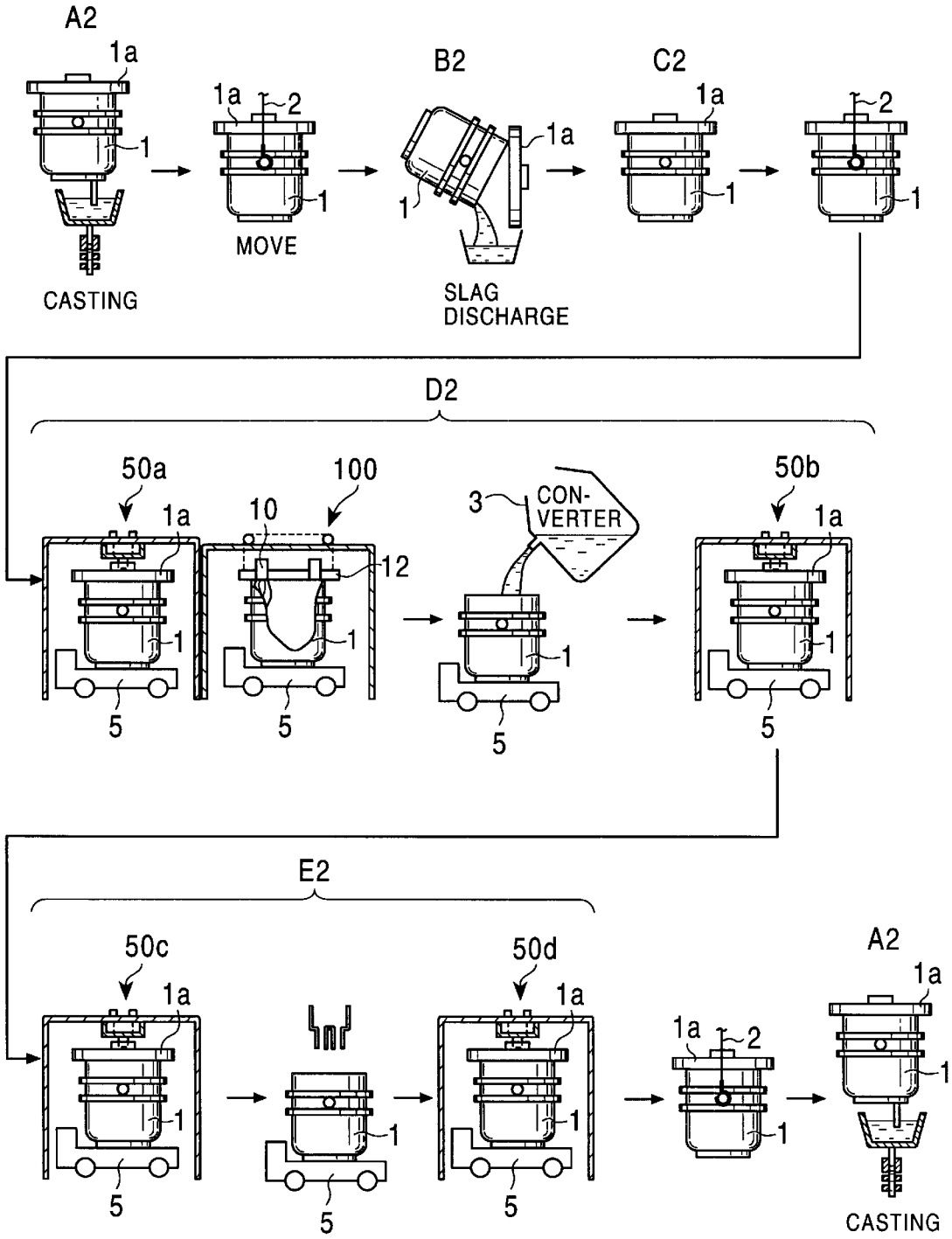
FIG. 2 is an illustration of another embodiment of selected steps in the ladle heating method in accordance with the present invention.
Figure 3:
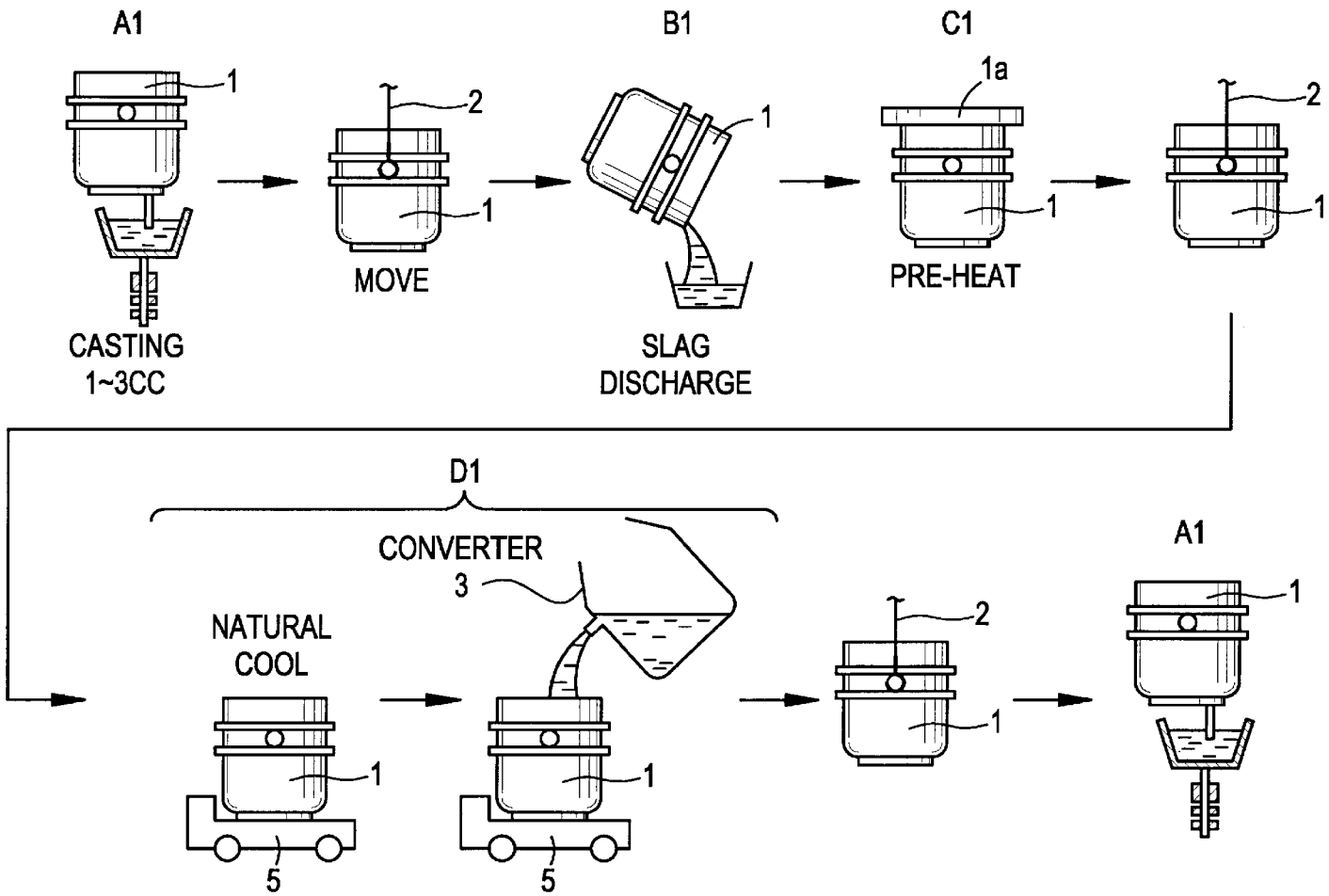
FIG. 3 PRIOR ART
FIG. 3 is an illustration of steps in a conventional ladle heating method.
Figure 7:
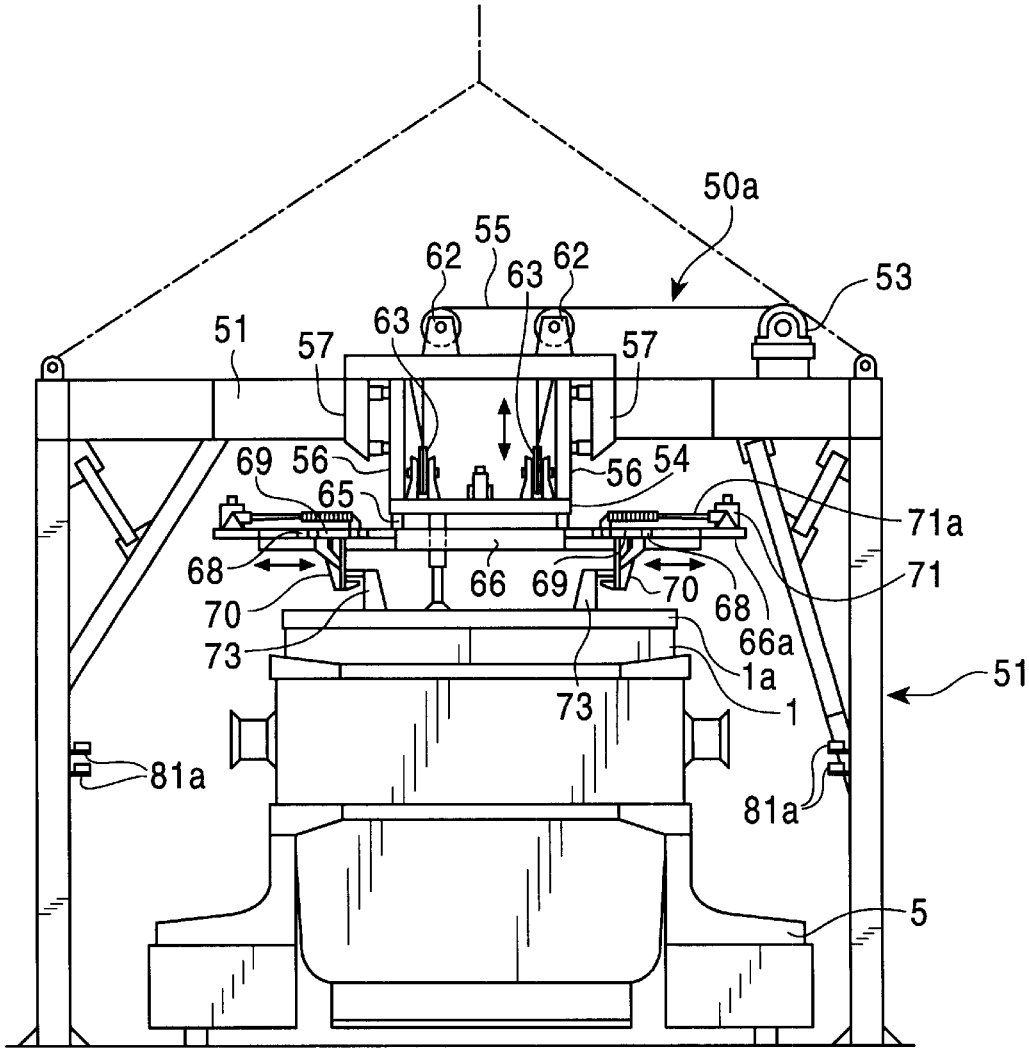
FIG. 7 is a schematic front elevational illustration of a second ladle lid lifting apparatus for opening and closing a top opening of a ladle.

A description will now be given of another embodiment of the ladle heating method which employs a first ladle lid and a second ladle lid. FIG. 2 is an illustration of selected steps of this ladle heating method, while FIG. 7 is an illustration of a ladle lid lifting device for lifting and lowering the second ladle lid to open and close a top opening of the ladle, as viewed from the trailing side in the direction of movement of a truck.

Referring to FIG. 2, a ladle 1 is used in a converter process. After delivering molten steel to a continuous casting process, the ladle 1 is moved by, for example, a crane 2 to a slag discharge station B2 where the ladle 1 is tilted to discharge slag remaining in the ladle 1. The ladle 1 is then moved to an inspection/maintenance station (not shown) where a sliding nozzle of the ladle 1 is scrubbed or replaced. The ladle 1 is then moved to a heat-preservation station C2. In this embodiment, the top opening of the ladle 1 is kept closed by a generally circular second ladle lid 1*a*, when it is moved from the continuous casting station A2 to the slag discharge station B2, until the ladle 1 is tilted to discharge the residual slag.

The second ladle lid la is disconnectably hinged at a peripheral portion thereof so as to be swung up and down. The arrangement is such that when the ladle 1 is tilted at the slag discharge station, the hinged second ladle lid 1*a* is swung to automatically open part of the top opening of the ladle 1, whereby the slag remaining in the ladle 1 is discharged. Then, as the ladle 1 resumes its upright posture, the second ladle lid 1*a* again fits on the top of the ladle 1 to close the top opening. The ladle 1 in this state is moved to the maintenance/inspection station and then to the heat-preserving station C2, where, unlike the known method in which the ladle 1 is preheated by the burners while the ladle 1 is held in this station, no positive heating is performed but heat in the ladle 1 is preserved by the second ladle lid 1*a* which closes the top opening of the ladle 1.

Then, the ladle 1 is mounted on the ladle truck 5 by crane 2, for example, and the ladle truck 5 runs to the tapping station D2 beneath the converter 3, to bring the ladle 1 to a predetermined position under a second ladle lid lifting device 50*a* which is provided in the tapping station D2. Then, the second ladle lid lifting device 50*a* is activated to detach the second ladle lid 1*a* from the ladle 1 on the ladle truck 5, thereby allowing the top of the ladle 1 to open.

Then, the ladle truck 5 is further moved to bring and hold the ladle 1 to and at a predetermined position near a first ladle lid lifting device 100 which is disposed adjacent to the second ladle lid lifting device 50*a*.

The ladle truck 5 which has brought the ladle 1 to the predetermined position near the first ladle lid lifting device 100 is held at that position for a predetermined stand-by period. During the stand-by period, the first ladle lid lifting device 100 is activated to bring a first ladle lid 12 to a position where it closes the top opening of the ladle 1. In this state, the ladle 1 is quickly heated by means of a regenerative-type burner system 10 mounted on the first ladle lid 12, to dehydrate the ladle 1 and to compensate for any drop of temperature which is expected to occur after the molten steel is received by the ladle 1.

Without delay after the quick heating of the ladle, the ladle truck 5 moves to bring the ladle 1 to a position beneath the converter 3, and the molten steel is tapped from the converter 3 into the ladle 1. The ladle 1 charged with the molten steel supplied from the converter 3 is then brought to a predetermined position near a second ladle lid lifting device 50*b* which is located adjacent to the converter 3. The second ladle lid lifting device 50*b* is then activated to bring the second ladle lid 1*a* again onto the ladle 1, thereby closing the top opening of the ladle 1. Although in the illustrated embodiment separate ladle lid lifting devices 50*a* and 50*b* are used, those skilled in the art will appreciate that a single ladle lid lifting device may be used to play the roles of these two separate ladle lid lifting devices 50*a* and 50*b*.

The ladle truck 5 is then moved to bring the ladle 1 to a secondary refining station E2 and to hold the ladle 1 at a predetermined position near a second ladle lid lifting device 50*c* provided in the secondary refining station E2. Thereafter, the second ladle lid 1*a* is detached from the ladle 1 on the ladle truck 5, by the operation of the second ladle lid lifting device 50*c*, whereby the top of the ladle 1 is opened.

Then, a secondary refining process is executed by, for example, an RH process using a lance inserted into the molten steel in the ladle 1. After refining, the ladle truck 5 is further moved to bring and hold the ladle 1 to and at a predetermined position near a second ladle lid lifting device 50*d*. The second ladle lid lifting device 50*d* is then activated to place the second ladle lid 1*a* again onto the ladle 1, thereby closing the top end of the ladle 1 with the second ladle lid 1*a*. Although in the illustrated embodiment separate ladle lid lifting devices 50*c* and 50*d* are used, those skilled in the art will appreciate that a single ladle lid lifting device may be used to play the roles of these two separate ladle lid lifting devices 50*c* and 50*d*.

Then, the ladle 1 carried by the ladle truck 5 is moved to the continuous casting station A2 by, for example, the crane 2. In this continuous casting station A2, the ladle 1 with its top opening covered by the second ladle lid 1*a* is situated on the continuous casting machine of a known type. Then, a sliding nozzle provided on the bottom of the ladle 1 is opened so that molten steel is supplied into the continuous casting machine at an appropriate rate, whereby continuous casting is performed. After continuous casting, the described process may be repeated.

For the purpose of clarification, a description will be made first in regard to the second ladle lid lifting devices 50*a* to 50*d*, with specific reference to FIG. 7. Since these second ladle lid lifting devices 50*a* to 50*d* have a substantially identical construction, the device 50*a* will be specifically described by way of example.

The second ladle lid lifting device 50*a* has a portal frame 51 which is arranged to straddle the path of movement of the ladle truck 5. A lifting unit 54 is suspended from the portal frame 51 by means of a wire rope 55 which is secured at its one end to a beam 51*b* of the portal frame 51. The wire rope 55 turns around a pulley 63 on the lifting unit 54 and a pulley 62 attached to the beam 51*b* of the portal frame 51, and is wound on a hoist drum 53. The hoist drum 53 is reversible to lift and lower the lifting unit 54. A plurality of slide posts protruding from the upper face of the lifting unit 54 are guided by guides which are secured to the beam 51*b* of the portal frame 51 to ensure smooth movement of the lifting unit 54 up and down.

A guide rail 65 is attached to the lower face of the lifting unit 54 to extend in the direction of the movement of the ladle truck 5. The guide rail 65 guides a slider 66 so that the slider 66 slides on the guide rail 65. A piston rod of a cylinder device (not shown) mounted on the lifting unit 54 is connected to the slider 66. The arrangement is such that the slider 66 slides along the guide rail 65 as the cylinder device is activated.

Rails 68 are disposed on both sides of the slider 66 as viewed in the breadthwise direction of the ladle truck 5. Each of these rails 68 extends in the breadthwise direction of the ladle truck 5 and carries a truck 69 which runs along each rail 68. Each truck 69 has a damper 70 projecting downward therefrom. To each truck 69 is connected a piston rod 71*a* of a cylinder device 70 which in turn is connected via a bracket 66*a* to the slider 66. The arrangement is such that extension and retraction of the piston rod 71*a* of the cylinder device 70 causes the associated truck 69 to move in the direction of the breadth of the ladle truck 5 together with the clamper 70. A driving unit for driving the hoist drum 53, the cylinder device connected to the lifting unit 54 and the cylinder device 71 connected to the slider 66 are controlled by means of a controller which is not shown.

In this embodiment, the second ladle lid lifting devices 50*a* and 50*c* are operative to detach the second ladle lid 1*a* from the ladle 1 carried by the ladle truck 5, while the second ladle lid lifting devices 50*b* and 50*d* are operative to attach the second ladle lid 1*a* to the ladle 1 carried by the ladle truck 5.

Catches 73 engageable with the dampers 70 are provided on the upper surface of the second ladle lid 1*a* at positions corresponding to these clampers 70. Each catch 73 has an upper.end bent to extend substantially horizontally toward the associated damper 70, so as to be engageable therewith. The disconnectable hinge structure between the peripheral part of the second ladle lid 1*a* and the top opening brim of the ladle 1 is such that the second ladle lid 1*a* is disconnected from the ladle 1 as the lid 1*a* is moved in the direction of movement of the ladle truck 5 away from the ladle 1, and the peripheral part of the second ladle lid 1*a* is again brought into engagement with the top opening brim of the ladle 1 for vertical swinging motion, as the second ladle lid 1*a* is moved closer to the ladle 1.

Detaching the second ladle lid 1*a* from the ladle 1 on the ladle truck 5 is effected by the second ladle lid lifting device 50*a* (50*c*) in a manner described below. The ladle truck 5 carrying the ladle 1 with the top opening closed by the second ladle lid 1*a* is moved to bring and station the ladle 1 to and at a predetermined position with respect to the portal frame 51 position where the ladle 1 can be engaged by the second ladle lid lifting device 50*a* (50*c*). This state is detected by position sensor 81*a* (or 81*b*) secured to, for example, a pillar of the portal frame 51. In response to a position signal from the position sensor, the driver of the hoist drum 53 is activated to loosen the wire rope 55, whereby the lifting unit 54 is lowered together with the clampers 70. Consequently, the dampers 70 are positioned to face, in the direction of the breadth of the ladle truck 5, the associated catches 73 on the second ladle lid 1*a* closing the top opening of the ladle 1. Then, the cylinder devices 71 connected to the slider 66 are activated to being the dampers 70 into engagement with the associated catches 73, and the cylinder device secured to the lifting device 54 is activated to disengage the second ladle lid 1*a* from the ladle 1. In this state, the driver of the hoist drum 53 is activated to take up the wire rope 55, whereby the second ladle lid 1*a* clamped by the dampers 70 is lifted to open the top of the ladle 1.

Conversely, attaching the second ladle lid 1*a* to the ladle 1 on the ladle truck 5 by the second ladle lid lifting device 50*b* (or 50*d*) is performed in a manner described below. The ladle truck 5 moves to bring the ladle 1 to a predetermined position with respect to the portal frame 51 where the second ladle lid lifting device 50*b* (50*d*) is located. This state is detected by a position sensor 81*a* (or 81*b*) secured to, for example, a pillar of the portal frame 51. In response to a position signal from the position sensor, the driver of the hoist drum 53 is activated to loosen the wire rope 55, whereby the lifting unit 54 is lowered together with the dampers 70, to a position where the second ladle lid 1*a* is held above the top opening of the ladle 1 but slightly spaced therefrom in the direction of movement of the ladle truck 5.

Subsequently, the cylinder device connected to the lifting unit 54 is activated to move the second ladle lid 1*a* closer to the ladle 1, thereby bringing the peripheral part of the second ladle lid 1*a* into hinging engagement with the top opening brim of the ladle 1. In this state, the driver of the hoist drum 53 operates to further loosen the wire rope 55, whereby the second ladle lid 1*a* is seated on the ladle 1 to close the top opening thereof.

After this closing operation, the cylinder devices 71 connected to the slider 66 are activated to disengage their dampers 70 from the associated catches 73 on the second ladle lid 1*a*, and the driver of the hoist drum 53 is activated to take up the wire rope 55, whereby the dampers 70 are moved upward together with the lifting unit 54.

The quick heating of the ladle 1 by means of the regenerative-type burner system 10 may be executed in the same way as that described before.

3. Third Aspect of the Invention

Figure 8:
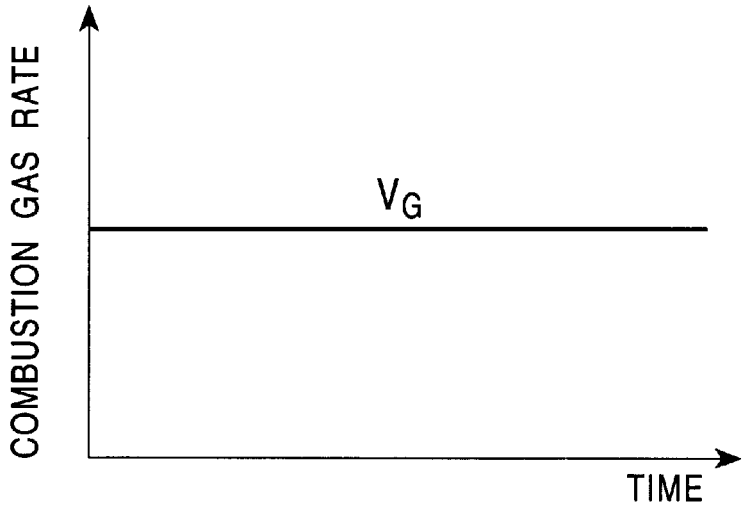
FIG. 8 is a graph showing the rate of combustion gas in relation to time.
Figure 9:
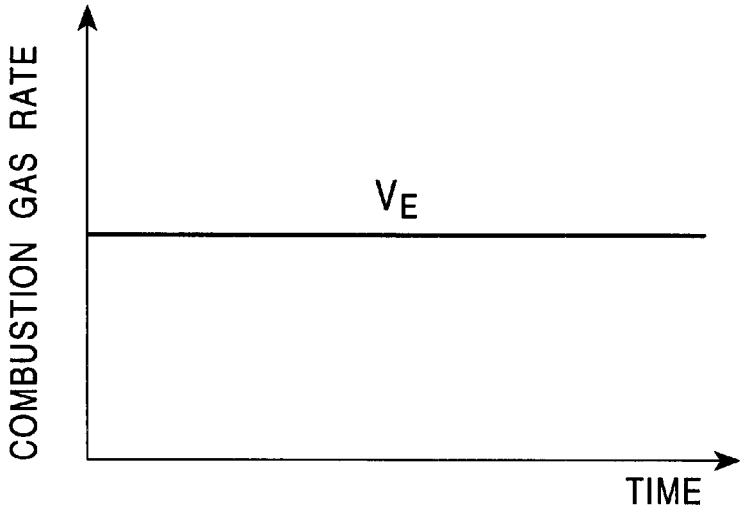
FIG. 9 is a graph showing the rate of exhaust gas in relation to time.
Figure 10:
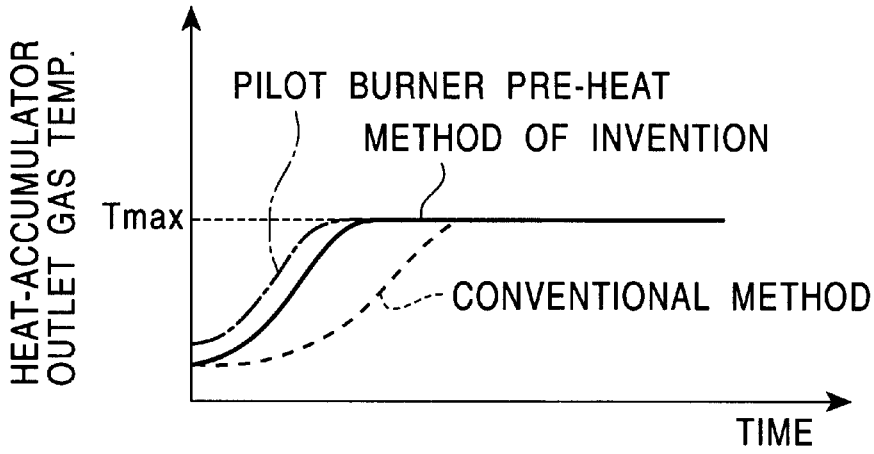
FIG. 10 is a graph showing the exhaust gas temperature at the outlet side of a heat regenerator in relation to time.
Figure 11:
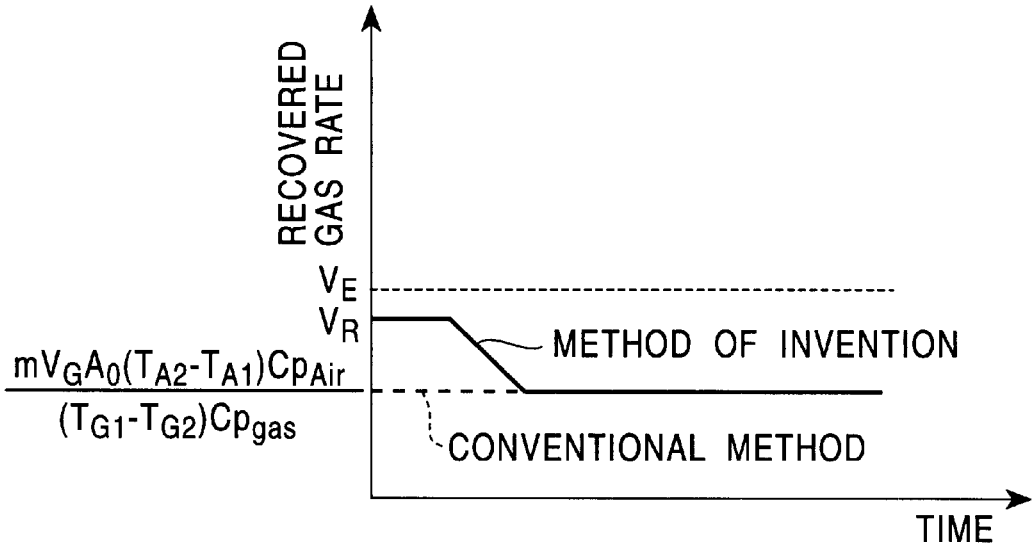
FIG. 11 is a graph showing the rate of recovery of gas in relation to time.
Figure 12:
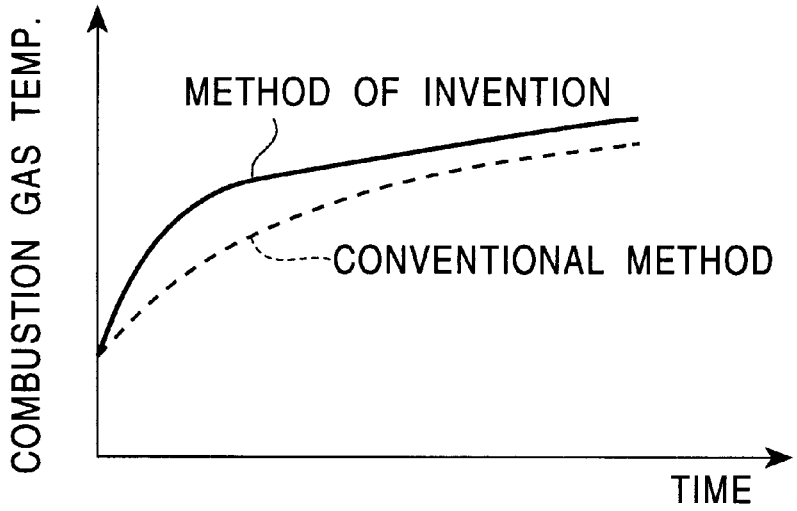
FIG. 12 is a graph showing the combustion gas temperature inside a ladle in relation to time.
Figure 13:
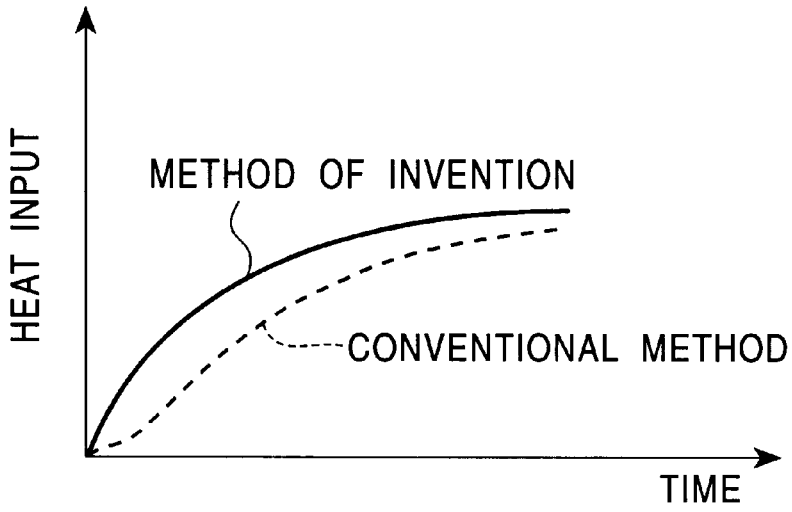
FIG. 13 is a graph showing the rate of input of heat in relation to time.

A third aspect of the present invention will now be described with reference to FIGS. 8 to 13. FIG. 8 is a graph showing the rate of combustion gas in relation to time. FIG. 9 is a graph showing the rate of exhaust gas in relation to time. FIG. 10 is a graph showing the exhaust gas temperature at the outlet side of a heat regenerator in relation to time. FIG. 11 is a graph showing the rate of recovery of gas in relation to time. FIG. 12 is a graph showing the combustion gas temperature inside a ladle in relation to time. FIG. 13 is a graph showing the rate of input of heat in relation to time.

In order to achieve a high efficiency of heating of the ladle 1 in the quick heating operation, the third aspect of the present invention is arranged as follows. When the burner unit 112*a* (112*b*) is used first in the beginning of the heating operation, the flow rate control valve 125 provided in the exhaust gas pipe 123 is operated to control the rate of recovery of the exhaust gas in accordance with the temperature measured by the thermometer Tb (Ta) for measuring the exhaust gas temperature at the outlet of the heat regenerator 113*b* (113*a*) associated with the burner unit 112*b* (112*a*) which is not operating. Thus, the same controlling operation is performed regardless of whether the burner unit 112*a* or the burner unit 112*b* is used for combustion. The explanation, therefore, is made on an assumption that the burner unit 112*a* is first activated, by way of example.

Referring to FIGS. 8 and 9, at the beginning of heating, the fuel gas is supplied to the burner unit 112*a* through the fuel gas supply pipe 128*a* at a constant rate $V_G$. Consequently, combustion gas to be exhausted from the ladle 1 is also generated at a constant rate $V_E$ which is expressed by $V_E=V_G\times(G_0+A_0(m-1))$, where $G_0$ represents stoichiometric combustion gas rate, $A_0$ represents stoichiometric air ratio, and m represents air ratio.

The rate of the combustion exhaust gas recovered through the heat regenerator 113*b* on the burner 112*b* is set to be equal to the rate $V_E$ of generation of the to combustion exhaust gas in the ladle 1. As a result, the temperature of the heat regenerator 113*b* is rapidly raised, so that the temperature of the combustion air supplied through this heat regenerator 113*b* is also elevated rapidly. Consequently, the temperature of the combustion gas can be raised to a high level from the beginning of heating, thereby improving efficiency of heating the ladle 1. However, if the rate of recovery of the combustion exhaust gas is constantly held at the same level as the rate $V_E$ Of generation of the combustion exhaust gas, the temperature of the exhaust gas at the outlet of the heat regenerator 113*b* is raised to an extraordinarily high level, beyond temperatures tolerable by the structural members supporting the heat regenerator 113*b* and by the devices such as the change-over valve 122*b* disposed in the exhaust gas pipe 121*b* and the exhaust fan 126. Conventionally, therefore, the rate $V_R$ of recovery of the combustion exhaust gas through the heat regenerator 113*b* and the exhaust gas pipes 121*b* and 123 is controlled from the beginning to the end of the combustion, such that the rate $V_R$ of the combustion exhaust gas, represented by a broken-line curve in FIG. 8, and the combustion air rate satisfy the condition of the following formula (1), to prevent the combustion exhaust gas temperature at the outlet of the heat regenerator 113*b* from exceeding a maximum temperature $T_{MAX}$ tolerable by the structural members and devices. This causes an impediment to the above-described improvement in the efficiency of heating the ladle 1.

$$mV_G A_0(T_{A2}-T_{A1})C_{pAir} \geqq V_R(T_{G1}-T_{G2})C_{pgas} \quad (1)$$

where, $T_{A2}$: combustion air temperature at heat regenerator outlet (as measured by Ta' and Tb')

$T_{A1}$: combustion air temperature at heat regenerator inlet (as measured by Ta and Tb)

$T_{G1}$: combustion exhaust gas temperature at heat regenerator inlet (as measured by Ta' and Tb')

$T_{G2}$: combustion exhaust gas temperature at heat regenerator outlet (as measured by Ta and Tb)

$C_{pAir}$: specific heat of combustion air $C_{pgas}$: specific heat of combustion exhaust gas $A_o$: stoichiometric air ratio m: air ratio Through intense study and research, the inventors have found that the above-described improvement in the ladle heating efficiency is achievable without allowing the exhaust gas temperature at the outlet of the heat regenerator 113*b* to rise beyond the temperature tolerable by the change-over valve 122*b* in the exhaust pipe 121*b* and other devices, by increasing the rate of recovery of the combustion exhaust gas in the beginning period of the heating to such an extent as not to cause the exhaust gas temperature at the outlet of the heat regenerator 113*b* to exceed the above-described maximum tolerable temperature $T_{MAX}$. The present invention has been accomplished based on this finding.

More specifically, referring to FIGS. 10 and 11, the rate $V_R$ of recovery of the combustion exhaust gas recovered through the heat regenerator 113*b* on the burner unit 112*b* in the beginning period of heating is set to a value which maximizes the temperature of the atmosphere, i.e., the combustion gas, in the ladle 1 and which falls within the range expressed by the following formula:

$$mV_G A_0(T_{A2}-T_{A1})C_{pAir}/(T_{G1}-T_{G2})C_{pgas} \leqq V_R \leqq V_E$$

Thereafter, the flow rate control valve 125 provided in the exhaust gas pipe 123 is controlled to fall within the range shown below, based on the temperature of the exhaust gas at the outlet of the heat regenerator 113*b* as measured by the thermometer Tb, such that the measured temperature does not exceed the maximum tolerable temperature $T_{MAX}$.

$$V_E \sim mV_G A_0(T_{A2}-T_{A1})C_{pAir}/(T_{G1}-T_{G2})C_{pgas}$$

Consequently, the exhaust gas temperature at the outlet of the heat regenerator 113*b* reaches the maximum tolerable temperature $T_{MAX}$ in a shorter time than in the known method, as will be seen from FIG. 7.

This heating method makes it possible to remarkably increase the combustion gas temperature inside the ladle 1 and, hence, the heat input to the ladle 1 as compared with the conventional method, without causing the supporting structural members of the heat regenerator 113*b* and the changeover valve 122*b* in the exhaust pipe 121*b* to be overheated to temperatures beyond the maximum tolerable temperature $T_{MAX}$, as will be seen from FIGS. 12 and 13. Consequently, the temperature of the atmosphere inside the ladle 1 can be elevated during the quick heating of the ladle 1 in a shorter time than in the known method, thus improving the efficiency of heating of the ladle 1.

After quick heating, the driving motor 109 on the portal frame 11 drives the sprocket 107 in such a direction as to lower the counter weight 108, whereby the ladle lid 12 carrying the regenerative-type burner system 10 is lifted to open the top of the ladle 1. Immediately after lifting the ladle lid 12, the ladle 1 is moved to the tapping position to receive the molten steel tapped from the converter 3. The ladle 1 filled with the molten steel is then conveyed by the ladle truck 5 to the secondary refining station (not shown), where the molten steel inside the ladle 1 is subjected to secondary refining process. After the secondary refining, the ladle 1 on the ladle truck 1 is conveyed by, for example, the crane 2 to the continuous casting station A2 where continuous casting is conducted.

In the described embodiment, the rate of recovery of the combustion exhaust gas is controlled by the flow rate control valve 125 in the exhaust pipe 123, based on the temperature of the exhaust gas at the outlet of the heat regenerator 113*b* (113*a*) as measured by the thermometer Tb (Ta). This, however, is not exclusive and other controlling methods may be employed for the control of the rate of recovery of the combustion exhaust gas. For instance, a recovery gas flow rate pattern as shown in FIG. 11 is set up beforehand based on the relationship between the temperature of the combustion exhaust gas at the outlet of the heat regenerator 113*b* (113*a*) and the rate of recovery of the combustion exhaust gas. This flow rate pattern is stored in a memory area of the heating controller. At the beginning of the heating, the flow rate control valve 125 in the exhaust pipe 123 is controlled in accordance with the above-described flow rate pattern, whereby the control is simplified and facilitated.

Although not shown, pilot burners may be provided on the burner units 112*a* and 112*b* of the regenerative-type burner system 10. Such pilot burners may be activated to pre-heat the heat regenerators 113*b*, 113*a* before the burner unit 112*a* or 112*b* is activated to start the heating of the ladle, i.e., before the ladle lid 12 carrying the regenerative-type burner 10 is lowered to close the ladle 1. The pre-heating of the heat regenerators 113*b* and 113*a* can be performed effectively, by activating the exhaust fan 126 while the change-over valves 122*a* and 122*b* in the exhaust gas pipes 121*a* and 121*b* are kept opened, because the combustion gas formed by the pilot burner can be drawn by the exhaust fan 126 through the heat regenerators 113*b* and 113*a*.

The described pre-heating of the heat regenerators 113*b* and 113*a* prior to the start of the heating with the burner unit 112*a* or 112*b* allows the exhaust gas temperature at the outlet of the heat regenerator 113*b* (or 113*a*) to reach the maximum tolerable temperature $T_{MAX}$ in a further shortened period of time, as shown by a chain-line curve in FIG. 7, thus achieving a further improvement in the efficiency of heating of the ladle 1.

4. Fourth Aspect of the Invention

A description will now be given of an embodiment in which the tapping temperature at which the molten steel is supplied from the converter 3 is controlled in accordance with the temperature given to the ladle 1 by the above-described method of quickly heating the ladle 1.

In this embodiment, the amount of heat possessed by the ladle refractories is determined based on the heat input and the sensible heat of the exhaust gas, and the temperature given to the ladle 1 by the quick heating is determined by the above-mentioned amount of heat, tapping rate f the molten steel from the converter, and the specific heat of the steel. Then, the tapping temperature at which the molten steel is discharged from the converter 3 is determined based on the temperature given to the ladle 1.

This control method will be described in detail. The amount of heat input during the quick heating is given by the following formula (2), while the sensible heat of the exhaust gas is determined by the following formula (3).

$$\int_0^{t1} (V_G \times Q_G)\, dt \tag{2}$$

$$\int_0^{t1} (V_E \times T_E \times C_P + V_E' \times T_E' \times C_P')\, dt \tag{3}$$

where, m: air ratio $V_G$: flow rate of fuel gas per unit time $A_0$: stoichiometric air flow rate $V_E$: gas recovery rate per unit time $V_{Etotal}$: exhaust gas rate per unit time $G_0$: stoichiometric exhaust gas rate $Q_G$: calorific value of fuel $T_E$: exhaust gas temperature at heat regenerator outlet $S_1$: area of ladle refractories $t_1$: heating time $C_p$: specific heat of exhaust gas at heat regenerator outlet $V_E'$: rate of non-recovered gas per unit time $T_E'$: temperature of non-recovered gas $C_p'$: specific heat of non-recovered gas Q: heat possessed by the ladle refractories M: tapping rate of molten steel from converter $C_{p0}$: specific heat of steel T: amount of reduction of tapping temperature allowed by virtue of heating of ladle $S_2$: area of ladle lid of quick heating system The calorific value $Q_G$ of the fuel gas is given. The flow rate $V_G$of the fuel gas and the rate $V_E$ of recovery of the exhaust gas may be values measured by flow meters or, if the deviations of the measured values from set values are within about 5%, set values may be used as the flow rates $V_G$and $V_E$. The rate $V_E'$ of non-recovered gas can be determined by subtracting the rate $V_E$ of recovered gas from the total exhaust gas rate $V_{Etotal}$ which is given by:

$$V_{Etotal} = V_G \times \{G_0 + A_0(m-1)\}$$

The exhaust gas temperature TE at the outlet of heat regenerator is measured by the thermometer Ta or Tb. The temperature $T_E'$ of the non-recovered gas is measured by the thermometer $T_c$. The specific heat $C_p$ is determined based on the exhaust gas temperature $T_E$ and the gas composition. The specific heat $C_p'$ is determined based on the gas temperature $T_E'$ and the gas composition.

The amount of heat Q possessed by the ladle refractory material can be determined by subtracting the sensible heat carried by the exhaust gas from the amount of input heat, in accordance with the following formula (4).

$$Q = \int_0^{t1} \{V_G \times Q_G - (V_E \times T_E \times C_P + V_E' \times T_E' \times C_P')\} \frac{s_1}{(s_1 + s_2)}\, dt \tag{4}$$

These computations are performed by the above-described heating controller. The amount of heat Q possessed by the ladle refractories, thus determined by the heating controller, is given to a process computer (not shown) which controls the rate of supply of carbonaceous materials into the converter and the rate of blowing oxygen into the converter.

The process computer determines the temperature T given to the ladle 1, based on the amount of heat Q possessed by the ladle refractories, molten steel tapping rate M and the specific heat $C_{p0}$ of the steel, in accordance with the relationship of $T=Q/M_{Cp0}$. The process computer then determines the tapping temperature in terms of the result $(T_0-T)$ of subtraction of the above-mentioned temperature T from a temperature $T_0$ which has been beforehand determined for each of the steel type as an index required for preserving the molten steel temperature high enough for the casting until the end of continuous casting. The process computer then controls the rate of supply of the carbonaceous materials and the rate of blowing oxygen into the molten steel inside the converter, so as to maintain the tapping temperature determined in accordance with the describe process.

In this embodiment also, heating of the ladle 1 is continued to a moment immediately before the ladle 1 receives the molten steel from the converter 3, so that the amount of heat possessed by the ladle refractories can be enhanced remarkably over that in the known method. This permits the tapping temperature at which the molten steel s discharged from the converter 3 to be set to a lower level, while allowing the molten steel temperature high enough for the casting until the end of the continuous casting. This serves to reduce the amount of the carbonaceous materials which are supplied as the temperature-raising material during blowing of the molten steel in the converter.

In particular, in accordance with the fourth aspect, the amount of heat possessed by the ladle refractories is determined based on the amount of heat input during the quick heating and the sensible heat carried by the exhaust gas, and the temperature given to the ladle 1 is determined based on the above-mentioned amount of heat possessed by the ladle refractories, rate of tapping of molten steel from the converter and the specific heat of the steel. The tapping temperature at which the molten steel is discharged from the converter is controlled based on this temperature given to the ladle 1. Consequently, the control of the tapping temperature can be performed in a more appropriate manner than in the case where the tapping temperature is controlled based solely on the temperature of the surface region of the ladle 1 established as a result of the quick heating.

In addition, the difference between the temperature of the ladle 1 and the tapping temperature at which the molten steel is discharged from the converter is reduced to correspondingly suppress the thermal attack on the ladle refractories, thus offering an extended use of the refractory material. At the same time, local variations of the molten steel temperature inside the ladle 1 can be minimized.

Furthermore, the time required for heating the ladle 1 is remarkably shortened as compared with the known method in which the ladle is heated by burners while the ladle is stationed at a pre-heating station. Consequently, the amount of the fuel gas (C gas) consumed in heating the ladle can be reduced, thus contributing to saving energy.

As will be understood from the foregoing description, the present invention makes it possible to set the tapping temperature to a low level, thus remarkably reducing the consumption of the carbonaceous materials, while suppressing the thermal attack on the ladle refractories, thus improving the unit ratio of the refractories. In addition, the present invention reduces the consumption of the fuel gas used in heating the ladle by means of burners, thus contributing to saving of energy.

What is claimed is:

1. A method of heating a ladle, comprising the steps of:

placing said ladle on a ladle mover and causing said ladle mover to bring said ladle to a tapping station wherein :molten steel is to be discharged from a converter;

stationing said ladle in said tapping station for a predetermined period of time;

quickly heating said ladle while said ladle is stationed in said tapping station; and causing said ladle mover to move to bring said ladle to a tapping position and causing said ladle to receive the molten steel from said converter, wherein the quick heating occurs in a time range from about 5 min. to 60 min. from a starting temperature of 400–900° C. to an ending temperature of 700–1200° C. wherein said ending temperature is greater than said starting temperature.

2. A method according to claim 1, wherein the quick heating dehydrates an interior molten steel holding space in said ladle and compensates for a lowering of the temperature effected by the molten steel tapped from the converter.

3. A method according to claim 1, wherein said ladle mover is a ladle truck.

4. A method of heating a ladle according to claim 1, wherein the quick heating of said ladle is performed by a regenerative burner system mounted on a ladle lid which closes a top opening of said ladle.

5. A method of heating a ladle, comprising the steps of:

quickly heating said ladle within a predetermined period in which said ladle is stationed at a tapping station where said ladle is to receive a molten steel from a converter, by means of a burner system mounted on a first ladle lid for covering and closing a top opening of said ladle; and maintaining said top opening of said ladle covered by a second ladle lid in an operational phase other than slag discharging, quick heating, tapping and secondary refining;

wherein the quick heating occurs in a time range from about 5 min. to 60 min. from a starting temperature of 400–900° C. to an ending temperature of 700–1200° C. wherein said ending temperature is greater than said starting temperature.

6. A method of heating a ladle according to claim 5, wherein said burner system is a regenerative burner system.

7. A method of heating a ladle with a burner system, comprising the steps of:

closing a top opening of said ladle with a ladle lid carrying said burner system, said burner system having at least a pair of burner units each having a heat regenerator, said burner units being alternately operable such that, when one of the burner units is activated to perform combustion, supply of combustion air and discharge of the combustion exhaust gas are conducted through the heat regenerator of the other burner unit;

alternately activating said burner units to perform combustion while said top opening of said ladle is kept closed by said ladle lid;

recovering combustion exhaust gas through an exhaust gas pipe via the heat regenerator of the burner which is not operating; and controlling the rate of recovery of the combustion exhaust gas by controlling a flow rate control valve provided in said exhaust gas pipe, based on the temperature of the combustion exhaust gas measured at the outlet of said heat regenerator.

8. A method of heating a ladle with a burner system, comprising the steps of:

closing a top opening of said ladle with a ladle lid carrying said burner system, said burner system having a pair of burner units each having a heat regenerator, said burner units being alternately operable such that, when one of the burner units is activated to perform combustion, supply of combustion air and discharge of the combustion exhaust gas are conducted through the heat regenerator of the other burner unit;

alternately activating said burner units to perform combustion while said top opening of said ladle is kept closed by said ladle lid, while recovering combustion exhaust gas through an exhaust gas pipe via the heat regenerator of the burner which is not operating; and controlling a flow rate control valve provided in said exhaust gas pipe, in accordance with a flow rate pattern of the combustion exhaust gas flowing through said exhaust gas pipe, said flow rate pattern being set up beforehand based on the relationship between the temperature of the combustion exhaust gas at the outlet of said heat regenerator and the rate of recovery of the combustion exhaust gas.

9. In a process in which a ladle after teeming for continuous casting and subsequent slag discharge is mounted on a ladle mover and then moved by said ladle mover to a tapping station, said ladle on said ladle mover then being stationed for a predetermined stand-by time, the ladle then being moved to a tapping position to receive molten steel from a converter, a method of heating said ladle before said ladle receives the molten steel from said converter, comprising the steps of:

quickly heating, during said predetermined stand-by time, said ladle with a regenerative burner system carried by a ladle lid which is attached to said ladle to cover a top opening of said ladle;

determining the amount of heat possessed by refractory material in said ladle based on the amount of heat input and sensible heat carried by exhaust gas from said burner system;

determining, based on the amount of heat possessed by the refractory material, a tapping rate at which the molten steel is discharged from said converter and the specific heat of said molten steel, a molten steel cool-down prevention temperature given to said ladle by the quick heating of said ladle; and controlling the tapping temperature at which the molten steel is discharged from said converter, in relation to the molten steel cool-down prevention temperature.

10. A method according to claim 9 wherein said amount Q of heat possessed by the ladle refractory material is determined based on the following formula (I), and the molten steel cool-down prevention temperature T is determined based on a relationship expressed by:

$$T=Q/MC_{p0}$$

and wherein the tapping temperature is determined in terms of subtraction of said molten steel cool-down prevention temperature T from a temperature $T_0$ that has been determined for each steel type as being necessary to keep the molten steel temperature high enough for casting until the end of the continuous casting, and the rate of supply of carbonaceous materials as the temperature controller and the rate of supply of oxygen are controlled in conformity with the tapping temperature:

$$Q = \int_0^{tl} \{V_G \times Q_G - (V_E \times T_E \times C_P + V'_E \times T'_E \times C'_P)\} \frac{s_1}{(s_1 + s_2)} dt \quad \text{(I)}$$

wherein,

Q: heat possessed by the ladle refractory material

M: tapping rate of molten steel from converter $C_{p0}$: specific heat of steel $V_G$: flow rate of fuel gas per unit time $Q_G$: calorific value of fuel $V_E$: gas recovery rate per unit time $T_E$: exhaust gas temperature at a heat regenerator outlet $C_p$: specific heat of exhaust gas at the heat regenerator outlet $V_E'$: rate of non-recovered gas per unit time $T_E'$: temperature of non-recovered gas $C_p'$: specific heat of non-recovered gas $t_1$: heating time $s_1$: area of ladle refractory material $s_2$: area of ladle lid of the heating system.

11. A method of using a regenerative burner system, comprising the steps of:

mounting, on a molten metal vessel, at least a pair of regenerative burner units each having a heat regenerator through which combustion air and combustion exhaust gas flow and a combustion chamber upstream of said heat regenerator;

alternately activating the regenerative burner units and recovering the combustion exhaust gas through the heat regenerator of the burner unit which is not operating, to thereby use recovered combustion exhaust gas as a source of heat for pre-heating combustion air;

providing an auxiliary burner in the combustion chamber of each regenerative burner unit; and simultaneously activating said auxiliary burners in said combustion chambers to introduce the combustion exhaust gases to said heat regenerators to maintain said heat regenerators at a temperature not lower than about 500° C., during a period in which said regenerative burner units are not activated so that the heating of said molten steel vessel is suspended.

12. A method of using a regenerative burner system according to claim 11, wherein, during suspension of heating of said molten metal vessel, combustion gas generated as a result of combustion on said auxiliary burners is drawn by an exhaust fan provided downstream of said heat regenerators, at substantially the same rate as the generation of said combustion gas.

13. A method of using a regenerative burner system according to claim 11, wherein pilot burners are provided on said regenerative burner units, and said pilot burners are substantially simultaneously activated in place of said auxiliary burners.

14. A method of using a regenerative burner system according to claim 12, wherein pilot burners are provided on said regenerative burner units, and said pilot burners are substantially simultaneously activated in place of said auxiliary burners.

* * * * *

UNITED STATES PATENT AND TRADEMARK OFFICE

CERTIFICATE OF CORRECTION

PATENT NO. : 6,540,957 B1
DATED : April 1, 2003
INVENTOR(S) : Hara et al.

It is certified that error appears in the above-identified patent and that said Letters Patent is hereby corrected as shown below:

Title page,
Item [75], Inventors, please add the inventor -- Nobukazu Kitagawa -- and delete the following inventors: "Nobutaka Goto" and "Kiyoshi Takahashi".

Column 12,
Line 10, please change "upper.end" to -- upper end --.

Signed and Sealed this

Third Day of August, 2004

JON W. DUDAS
*Acting Director of the United States Patent and Trademark Office*